United States Patent [19]

Wirsbinski

[11] 4,432,402

[45] Feb. 21, 1984

[54] SELF-ELEVATING WOOD SPLITTER

[75] Inventor: James L. Wirsbinski, Marshfield, Wis.

[73] Assignee: J. I. Case Company, Racine, Wis.

[21] Appl. No.: 485,964

[22] Filed: Apr. 18, 1983

Related U.S. Application Data

[63] Continuation-in-part of Ser. No. 380,687, May 21, 1982, abandoned.

[51] Int. Cl.[3] ..... B27L 7/00

[52] U.S. Cl. ..... 144/193 A; 144/193 K

[58] Field of Search ..... 144/193 R, 193 A, 193 K; 280/415 R, 415 A; 83/928

[56] References Cited

U.S. PATENT DOCUMENTS

| | | | |
|---|---|---|---|
| 3,760,854 | 9/1973 | Worthington | 144/193 A |
| 3,938,567 | 2/1976 | Dircksen et al. | 144/193 A |
| 4,153,088 | 5/1979 | King et al. | 144/193 A |
| 4,199,015 | 4/1980 | Doering | 144/193 A |
| 4,236,556 | 12/1980 | Smith | 144/193 A |
| 4,239,070 | 12/1980 | Burns | 144/193 A |
| 4,240,476 | 12/1980 | Rattray | 144/193 A |
| 4,246,942 | 1/1981 | Malik | 144/193 A |
| 4,258,765 | 3/1981 | Suomi | 144/193 A |

*Primary Examiner*—W. D. Bray

*Attorney, Agent, or Firm*—Dressler, Goldsmith, Shore, Sutker & Milnamow, Ltd.

[57] ABSTRACT

A hydraulic log splitter attachable to a tractor or the like having self-contained means for raising or lowering the machine. The motive power for the elevating means is the hydraulic ram itself and only a single, fixed attachment to the tractor is required. There is also disclosed a twin-tube log bed and adjustable stabilizing means for the machine. In one embodiment of the invention, means are provided for releasably slidably mounting the twin-tube log bed, which permits the splitter to be collapsed to a relatively compact size for shipment, storage and transport.

32 Claims, 9 Drawing Figures

FIG. 1
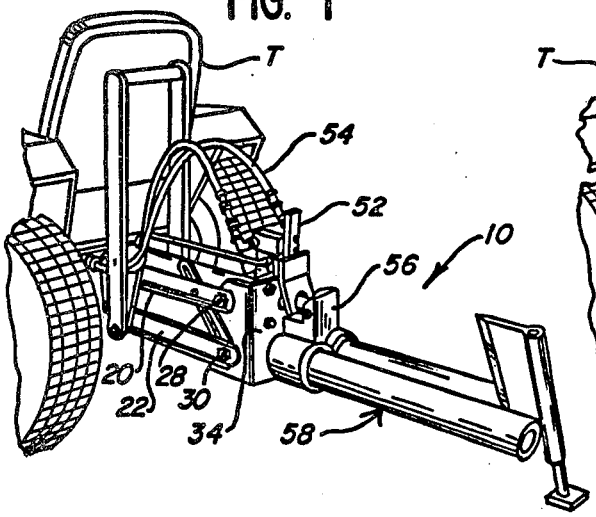
FIG. 2
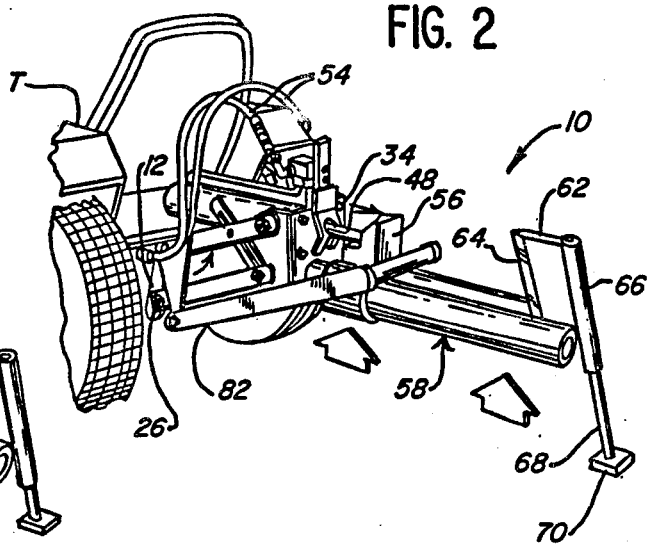
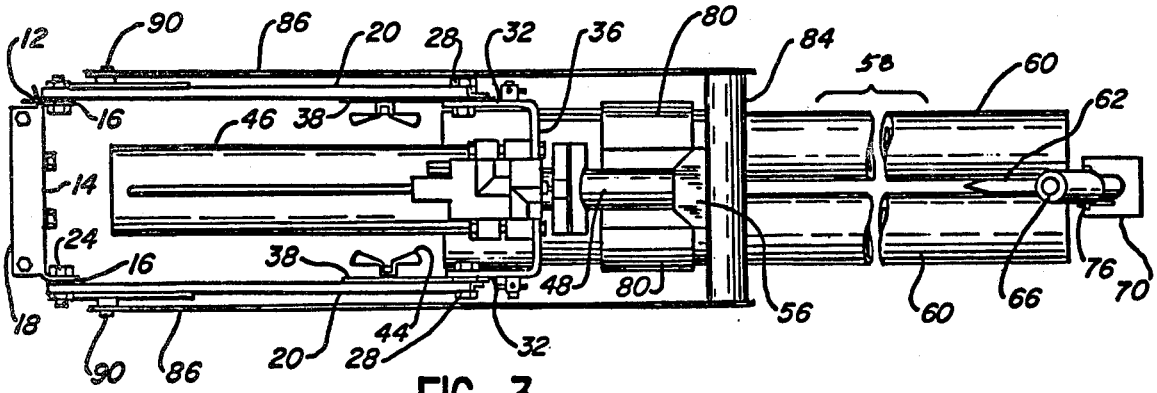
FIG. 3
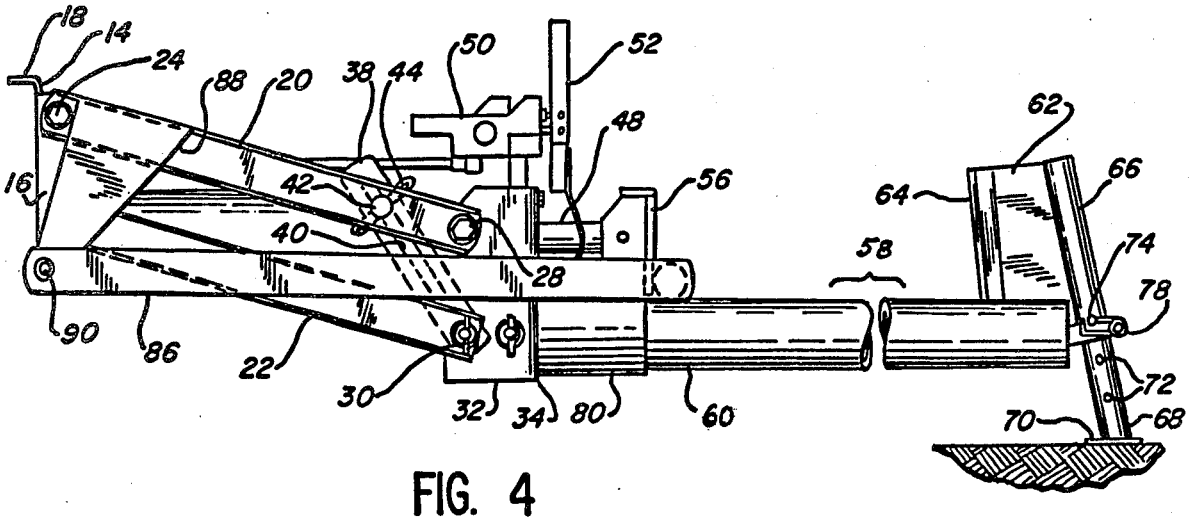
FIG. 4

SELF-ELEVATING WOOD SPLITTER

CROSS-REFERENCE TO RELATED APPLICATION

This application is a continuation-in-part of application Ser. No. 380,687, filed May 21, 1982, now abandoned.

BACKGROUND OF THE INVENTION

This invention relates to hydraulically operated wood or log splitters of the type that is attachable to tractors or similar vehicles and, more particularly, to an improved wood splitter having its own self-contained means for raising or lowering the device to any desired height. In one illustrated embodiment, a collapsible frame arrangement is provided to facilitate convenient shipment, storage, and transport of the splitter.

Hydraulically operated wood splitting machines are well known and heretofore have been provided in a great variety of forms. An early example of such machines is U.S. Pat. No. 885,458, which teaches a device for use in a mill, or the like, and is designed to be fixedly mounted on the floor or ground.

Also well known are wood splitting machines designed as attachments to tractors or other vehicles having a source of hydraulic power. While those machines had the obvious advantage of portability, they were nonetheless characterized by other disadvantageous features. For example, many of those machines occupied a fixed vertical relationship to the ground and could be operated only at that single level irrespective of prevailing ground conditions or particular working conditions, such as, size and weight of logs being handled, worker fatigue and nature of ancillary equipment employed for storage or handling. Representative of such fixed-level machines are those shown in U.S. Pat. Nos. 4,153,088, 4,236,556, 4,239,070, and 4,240,476.

Workers skilled in the art are fully aware of the desirability of adjustable height capability for wood splitting machines. Efforts to provide such capability may be seen in U.S. Pat. Nos. 3,319,675, 3,760,854, and 3,938,567. However, those height-adjustable machines have been only partially successful, at best, for a number of reasons. Generally, those machines required a complicated, expensive and adjustable three-point connection to the tractor. Operation of the raising mechanism necessitated hydraulic controls and connections in addition to those which operated the ram. However, raising of the machine frequently resulted in the tilting thereof to a non-horizontal upwardly inclined position which placed undue stress on the equipment and could also be dangerous to workers.

SUMMARY OF THE INVENTION

The present invention provides a hydraulically operated wood splitter attachable to a tractor, or similar vehicle, and which overcomes the problems described above. The inventive wood splitter has self-contained means for raising or lowering the machine through a wide range of positions. The motive power for the elevation operations is provided by the same ram which is employed for splitting wood. Through the entire range of adjustable height positions, the ram and wood-supporting frame remain horizontal or level with the supporting ground.

A novel four-bar linkage is included in the machines supporting framework. This construction enables the desired horizontal relationship to be maintained at all levels. In addition, only a single fixed connection to the tractor is required, thereby eliminating the prior three-point, adjustable connections.

When raising or lowering is desired, the self-contained means may be readily moved into cooperating relationship with the ram. Locking means are provided for retaining the machine at the desired level. The self-contained means may then be just as readily moved away whereupon the ram and machine are again ready for wood splitting operations.

The only hydraulic connections required are those which conventionally operate the ram. Similarly, the only controls required are those which conventionally operate the ram, and they may be likewise self-contained and mounted on the machine.

The framework for supporting the logs or other wood during the splitting operations is extremely durable and ensures proper positioning and retention of the wood thereon. In this regard, said framework comprises a pair of cylindrical tubes or pipes mounted in parallel, spaced apart relationship.

Notably, one of the embodiments disclosed herein includes a collapsible wood supporting framework which permits the cylindrical wood supports to be easily moved from their normally extended disposition to a retracted position to facilitate shipment, storage and transport of the splitter. A removable pin arrangement is provided to releasably maintain the cylindrical wood supports in their extended position for operation.

Means for stabilizing the machine is likewise provided to compensate for ground surface irregularities and excessive load stresses. The stabilizing means includes an adjustable standard which cooperates with a splitting wedge positioned at the free or distal end of the machine.

Other features and advantages of the invention will be apparent from the following description and claims and are illustrated in the accompanying drawings which show structure embodying preferred features of the present invention and the principles thereof.

BRIEF DESCRIPTION OF THE DRAWINGS

FIG. 1 is a perspective view of a wood splitting machine embodying the principles of the invention attached to the rear of a tractor, or similar vehicle, and showing the same in a close-to-the-ground position and ready for wood splitting;

FIG. 2 is a similar view, but showing the relationship of parts during raising of the machine;

FIG. 3 is an enlarged top plan view of the machine alone showing the same in the raised condition of FIG. 2;

FIG. 4 is a side elevational view of the machine showing the relationship of parts during lowering thereof;

DESCRIPTION OF THE PREFERRED EMBODIMENT

Figure 5:
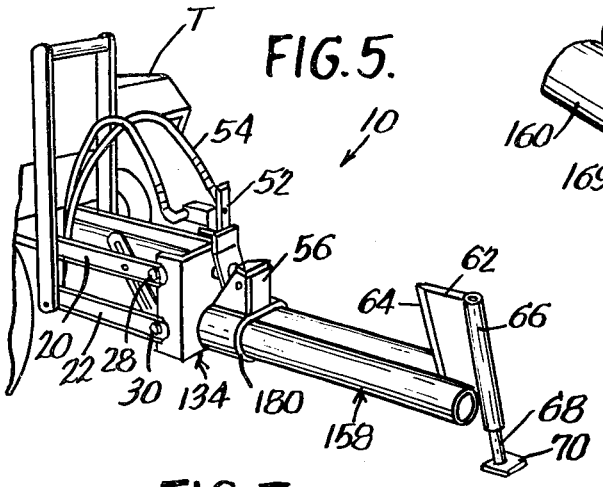
FIG. 5 is a perspective view of an alternate embodiment of the present wood splitting machine attached to the rear of a tractor.

Turning now with greater particularity to the various Figures of the drawings, it will be seen that the reference character 10 indicates generally a self-elevating wood splitter embodying the principles of the invention attached and operationally connected to a tractor T. At its front end, the wood splitter 10 comprises a front mounting plate 12 having a central wall 14, a pair of sidewalls 16, 16, and an integrally formed top wall 18 extending forwardly from the central wall. The front mounting plate 12 is rigidly connected to the tractor T by means of the top wall 18 and bolts, or other suitable fasteners (not shown).

A top link 20 and a bottom link 22 are pivotally connected to each of the sidewalls 16 at 24 and 26, respectively. Since the linkage structure on both sides of the wood splitter is the same, only one side will be described in detail, it being understood that the other side is the mirror image of the side described.

The opposite ends of the links 20 and 22 are pivotally connected at 28 and 30, respectively, to the sidewall 32 of a second, channel-shaped rear mounting plate 34. Mounting plate 34 comprises further a central wall 36, and said central wall is of substantially identical width to that of central wall 14 of front mounting plate 12. It will thus be appreciated that the mounting plate sidewalls 16 and 32 and the pivotally connected links 20 and 32 comprise a connection commonly known as a four-bar linkage.

An adjustable locking link 38 is likewise pivotally connected to mounting plate sidewalls 32 at 30. The locking link 38 is formed with an elongated slot 40 which slidably accommodates therein a locking bolt 42 carried by the top link 20, and a wing nut, such as 44, is threadedly engaged on said bolt. When rear mounting plate 24 is pivoted or moved with relation to the stationary front mounting plate 12, the distance between the parallel links 20 and 22 of the four-bar linkage narrows causing the locking bolt 42 to ride in the slot 40 of the locking link 38. Any desired position or elevation of the rear mounting plate 34 can thereupon be maintained by simply tightening the wing nut 44.

A hydraulic cylinder 46 of conventional construction is mounted on the rear mounting plate 34 and projects forwardly therefrom. Cylinder 46 includes a piston 48 extensible through an opening in the central wall 36 of the plate 34, and conventional valve control means 50 and 52 operationally connected by lines 54 to the hydraulic system of the tractor. The piston 48 carries a ram 56 which functions in a dual capacity to be subsequently described.

The distal portion of the wood splitter 10 comprises an elongated bed or frame 58 for retaining the workpiece thereon during the splitting operation. Frame 58 comprises a pair of spaced, parallel cylindrical tubes 60, 60 which are mounted from the central wall 36 of the mounting plate 34. A stationary wedge 62 having a cutting edge 64 is positioned between the tubes 60 at their free ends and is welded or otherwise permanently connected therebetween. The wedge 62 comprises further a tubular rear edge 66 which is of greater diameter than the thickness of the wedge blade itself. In general, the wedge 62 functions in conventional manner, that is, as a stationary splitting blade against which the log or other wood is driven by the ram 56. It should be noted, however, that the cutting edge 64 is positioned at a slightly acute angle with relation to the plane of the frame 58. It has been found that this angled relationship greatly reduces the tendency of the driven workpiece to ride up from the supporting frame. It will also be noted that the rear edge 66 provides a second and wider wedge which aids in the wood splitting function.

Cooperating telescopically with the wedge rear edge 66 is a tubular standard 68 having an enlarged base 70. Standard 68 is formed with a plurality of diametral positioning holes 72 adapted to be selectively aligned with diametral holes 74 formed near the bottom of the tubular edge 66.

A headed pin such as 76 is insertable through any aligned pair of openings 72 and 74 and may be secured therein by a suitable pin such as 78. It will thus be appreciated that when the standard and wedge are adjusted to the height dictated by ground and frame height conditions, the same serves to support and stabilize the machine and its associated tractor.

A pair of tubular sleeves 80, 80 is slidably mounted on the tubes 60. The sleeves 80 are bridged by, and permanently affixed to, the bottom of the ram 56 to form an integrated, slidable unit therewith. It will thus be seen that the tubes 60 additionally function as a trackway or guide for the ram 56. Since the spaced apart tubes 60 ensure secure seating of the workpiece on the bed 58, irrespective of size or shape, efficient contact of the workpiece by the ram, and the splitting thereof by the wedge 62, is likewise assured.

For purposes of raising or lowering the bed 58, there is provided an elevator link 82 adapted to cooperate with the ram 56. Elevator link 82 comprises a pressure bar 84 and a pair of elongated arms 86, 86. A lift plate 88 is welded to the top link 20 and depends therefrom to a point below the pivot point 26 of the bottom link 22. Each of the elevator link arms 86 is pivotally connected to a lift plate 88 adjacent the bottom thereof as at 90.

When it is desired to raise the bed 58, the elevator link 82 is pivoted into cooperating relationship with the ram 56, that is, with the pressure bar 84 resting on said bed as illustrated in FIGS. 2–4. Wing nuts 44 are loosened and the ram operated until the desired height of the bed 58 is reached, such as that illustrated in FIGS. 2 and 3. Tightening of the wing nuts 44 locks the bed into that desired position, and the elevator link 82 may now be pivoted into the inoperative position shown in FIG. 1, whereupon the machine is ready for its wood splitting operations. Alternatively, the elevator link arms 86 may comprise relatively thin and flexible members enabling the pivots 90 to be disconnected and the entire elevator link removed from the machine during wood splitting operations.

The raising operation is achieved with normal use of the ram 56 and no additional motive force or hydraulic connections are required. Irrespective of the height to which the bed 58 is raised, the operation of the novel four-bar linkage causes the bed to remain in the desired horizontal orientation.

In order to lower the bed 58, it is simply necessary to reverse the procedure. After loosening of the wing nuts 44, the weight of the machine will cause the same to drop but for the bearing of the pressure bar 84 against the extended ram 56. The ram may now be operated as a brake and withdrawn until the desired lowered position is achieved, such as that shown in FIG. 4. Again, it will be observed that the bed 58 retains its horizontal orientation at all times.

When heavy or bulky logs are being split, the frame 58 may be lowered substantially to ground level to facilitate rolling of the logs thereon. When smaller workpieces are being handled, or the same are being taken from an elevated structure, such as a wagon or storage bin, the frame 58 may be raised to whatever convenient height is desired by the worker.

Referring now to FIGS. 5–9, a modified embodiment of the present wood splitter 10 is illustrated. Many of the components of this embodiment are identical in structure and function to like components of the previously described embodiments, and such components are so identified by the same reference numerals. In contrast, components of this embodiment which are similar to, but different from, the like components of the previous embodiment are identified by like reference numerals in the one hundred series.

This embodiment of the present splitter includes a collapsible wood supporting frame arrangement which permits the frame of the splitter to be selectively moved between extended and retracted positions. By this construction, the frame can be releasably maintained in its extended position for operation of the splitter, with the frame being movable to its retracted position so that the entire machine is more compact, thus facilitating convenient shipping, storage, and transport of the splitter. If desired, the frame can also be completely removed, such as for service or repair of the splitter.

In this embodiment, a modified second, rear mounting plate 134 having sidewalls 136 is pivotally interconnected with top and bottom links 20 and 22 at 28 and 30, respectively. Thus, the pair of four-bar linkage arrangements of the splitter's preferred height adjusting mechanism is provided. A modified wood supporting frame 158 is mounted on rear mounting plate 134, and comprises a pair of spaced, parallel cylindrical wood supporting tubes 160. Wood supporting tubes 160 are adapted to extend rearwardly of rear mounting plate 134 when the tubes are in their extended positions for operation of the splitter.

Figure 6:
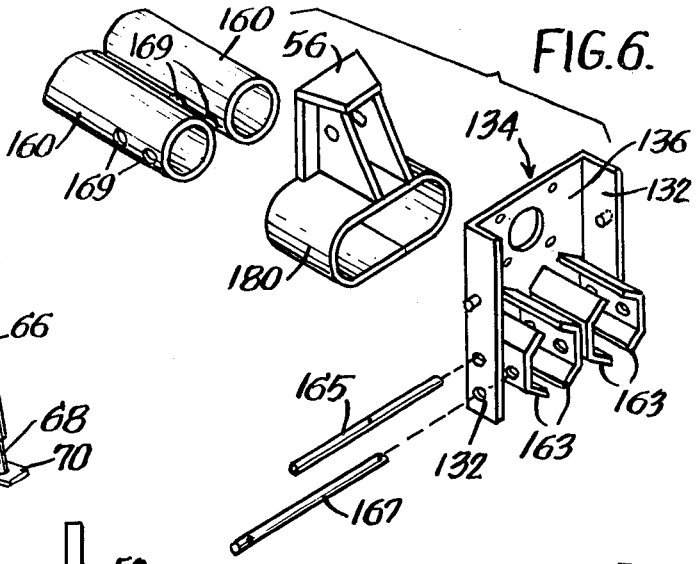
FIG. 6 is an exploded perspective view of a portion of the wood supporting framework of the wood splitter illustrated in FIG. 5.

Notably, wood supporting tubes 160 are releasably slidably mounted on the central wall 136 of rear mounting plate 134 by means of a releasable frame mounting arrangement. As best illustrated in FIG. 6, the frame mounting arrangement includes first and second pairs of respectively opposed sleeve segments 163 which are affixed to the central wall 136 of rear mounting plate 134. In the preferred embodiment, each of sleeve segments 163 has a generally semi-hexagonal cross-sectional configuration. This preferred configuration has been found to be readily fabricated, and provide very rigid and secure support for wood supporting tubes 160. Each pair of sleeve segments 163 is adapted to receive a respective one of tubes 160, with the sleeve segments preferably configured to securely and firmly engage and embrace the tubes 160, but permit sliding movement of the tubes within the pairs of the sleeve segments in a generally telescopic manner.

Figure 7:
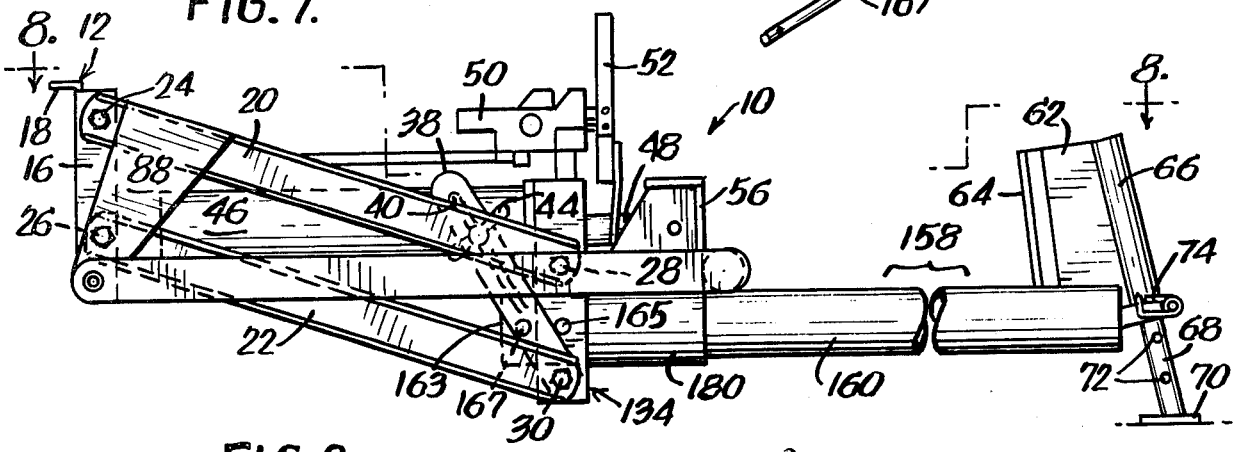
FIG. 7 is a side elevational view of the embodiment of the present wood splitter illustrated in FIG. 5.
Figure 8:
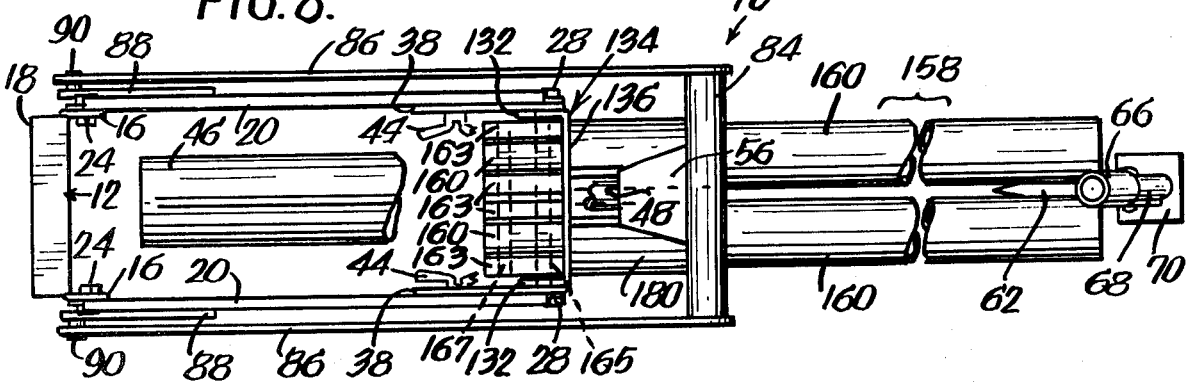
FIG. 8 is a plan view, partially in cross-section and cutaway, taken generally along lines 8—8 of FIG. 7.

In order to releasably maintain wood supporting tubes 160 in their extended positions, a removable pin arrangement is preferably provided for coaction with the tube-supporting sleeve segments 163. To this end, a pair of removable mounting pins 165 and 167 are preferably provided for maintaining tubes 160 in their extended positions. With the ends of tubes 160 respectively received within the first and second pairs of sleeve segments 163, pin 165 is adapted to extend through sidewalls 132 of rear mounting plate 134, through both pairs of sleeve segments 163, and through tubes 160 by way of openings 169 defined by the tubes. Similarly, pin 167 is adapted to extend through sleeve segments 163 and through wood supporting tubes 160. FIGS. 6 and 7 best illustrate the configuration of the various components when wood supporting tubes 160 are in their extended positions for operation of splitter 10. It will be noted that the disposition of sleeve segments 163 on the side of rear mounting plate 134 opposite of the log bed formed by tubes 160 permits the splitter to operate through its normal working stroke without interference with the sleeve segments.

Figure 9:
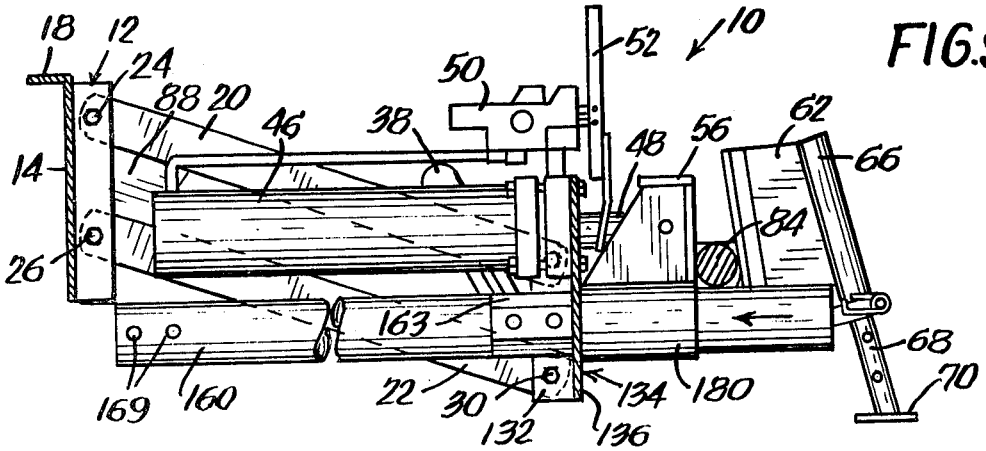
FIG. 9.is a side elevational view of the embodiment of the present wood splitter illustrated in FIGS. 5–8 showing the collapsible action of the wood supporting framework.

FIG. 9 illustrates the collapsible nature of the wood supporting frame of splitter 10 in accordance with this embodiment. In order to move the wood supporting tubes 160 from their extended positions, pins 165 and 167 are withdrawn from their respective mounting holes so that tubes 160 are slidable within their respective pairs of sleeve segments 163. The tubes 160 can then be easily pushed or otherwise moved toward front mounting plate 12 of the splitter, thus desirably substantially decreasing the overall length of the splitter. It will be noted that because tubes 160 are mounted on rear mounting plate 148 generally below hydraulic cylinder 46, the tubes 160 can be easily moved to their retracted positions at almost any selected elevation of the wood splitter. By rendering the wood splitter 10 more compact in size, convenient transport of the splitter on tractor T is facilitated. Similarly, the collapsible nature of this embodiment of the present wood splitter permits it to be more easily stored and shipped. As will be recognized, this mounting arrangement also permits tubes 160 to be completely removed from sleeves 163 and mounting plate 134, thus facilitating convenient service and repair of the splitter.

With further reference to FIGS. 5–9, this embodiment of the present wood splitter includes a modified guiding arrangement for the hydraulically driven ram 56. Specifically, a generally oval-shaped collar 180 is provided to which ram 56 is affixed, with the collar 180 extending about and being slidably mounted on wood supporting tubes 160. Thus, tubes 160 provide a trackway for guiding the movement of ram 56 as the splitter is operated. The provision of a single collar 180 which extends about and embraces both of tubes 160 has been found to provide the splitter with a relatively smoother working action. Since collar 180 extends about both of tubes 160, any binding which can result because of non-parallelism of tubes 160 is abated. The relatively reduced contact area of collar 180 (as compared with a pair of tubular sleeves 80 as in the previously described embodiment) further reduces the possibility of binding or chattering during the splitter operation. Additionally, the construction including a single collar 180 is more economical to fabricate than a similar arrangement having a pair of tubular sleeves.

It will, of course, be appreciated that the novel height adjustment means of the invention may be employed with any wood splitter having a wood frame and a movable ram, irrespective of the type and nature of mounting and operation of the splitting wedge. It should also be understood that, while specific embodiments have been illustrated and described herein, changes and variations may be made by those skilled in the art without departing from the spirit and scope of the appended claims.

What is claimed is:

1. A hydraulic wood splitter adapted to be connected to a tractor, or the like, comprising:

front mounting means for effecting a fixed connection to said tractor;

an elongated wood supporting frame connected to said front mounting means;

means for mounting said wood supporting frame for movement between an extended position and a retracted position with respect to said front mounting means;

means on said frame for splitting wood including hydraulic ram means mounted on said wood supporting frame and movable therealong in the extended position of said frame;

height adjustment means operatively associated with said front mounting means for permitting vertical movement of said wood supporting frame and said ram;

locking means for releasably locking said wood supporting frame at any desired elevation; and elevator means associated with said height adjustment means and selectively movable into operative association with said ram means whereby movement of said ram means effects raising or lowering of said wood supporting frame.

2. The wood splitter of claim 1 in which said height adjustment means comprises linkage means effective for maintaining the horizontal orientation of said wood supporting frame at all elevations thereof.

3. The wood splitter of claim 2 in which said front mounting means comprises a first mounting plate, a second mounting plate to which said frame mounting means is affixed for carrying said wood supporting frame and ram, and said linkage means pivotally interconnecting said first and second mounting plates in substantially parallel relationship.

4. The wood splitter of claim 3 in which said frame mounting means comprises means for releasably slidably mounting said wood supporting frame on said second mounting plate to permit said frame to be selectively moved toward said first mounting plate.

5. The wood splitter of claim 4 in which said frame mounting means includes removable pin means for releasably maintaining said wood supporting frame in said extended position.

6. The wood splitter of claim 1 in which said wood supporting frame comprises a pair of parallel, spaced cylindrical tubes, said splitter further comprising a collar extending about and slidably mounted on said tubes, said ram being fixedly connected to said collar whereby said tubes provide a trackway for said ram.

7. The wood splitter of claim 6 in which a splitting wedge is fixedly mounted on said wood supporting frame adjacent the rear end thereof, said wedge comprising a cutting edge facing toward said ram, said cutting edge being mounted at an acute angle with relation to the plane of said supporting frame.

8. The wood splitter of claim 4, in which said wood supporting frame comprises a pair of parallel, spaced cylindrical tubes, said frame mounting means comprising sleeve means affixed to said second mounting plate, said sleeve means being adapted to embrace said cylindrical tubes and releasably slidably support said tubes for movement between said extended and retracted positions.

9. The wood splitter of claim 8 in which said sleeve means comprises first and second pairs of sleeve segments, each said pair of sleeve segments being adapted to embrace and support a respective one of said tubes.

10. The wood splitter of claim 9, in which each said sleeve segment has a generally semi-hexagonal configuration.

11. The wood splitter of claim 9 in which said frame mounting means includes removable pin means adapted to extend through and coact with said first and second pairs of sleeve segments and said cylindrical tubes to releasably maintain said tubes in said extended position.

12. A hydraulic wood splitter adapted to be connected to a tractor, or the like, comprising:

a first mounting plate for fixed attachment to said tractor;

a top link and a bottom link pivotally connected at one end thereof to each lateral side of said first mounting plate;

a second mounting plate substantially parallel to said first mounting plate and pivotally connected at each lateral side thereof to the opposite ends of said top links and bottom links;

said links and mounting plates providing a pair of four-bar linkages;

an elongated wood supporting frame including a pair of spaced, cylindrical wood supporting tubes;

frame mounting means including sleeve means affixed to said second mounting for releasably slidably supporting said tubes on said second mounting plate;

a splitting wedge mounted on said wood supporting frame adjacent the rear end thereof;

hydraulic ram means mounted on said second mounting plate and movable over said wood supporting frame and toward said splitting wedge;

elevator means associated with said four-bar linkages and selectively movable into operative association with said ram means whereby movement of said ram means effects raising and lowering of said wood supporting frame; and locking means associated with said four-bar linkages for releasably locking said wood supporting frame in any desired elevation.

13. The wood splitter of claim 12 in which said sleeve means comprises first and second pairs of sleeve segments, each said pair of segments being adapted to releasably slidably support a respective one of said wood supporting tubes.

14. The wood splitter of claim 13 in which each said sleeve segment has a generally semi-hexagonal cross-sectional configuration.

15. The wood splitter of claim 13 in which said frame mounting means includes removable pin means adapted to extend through said first and second pairs of sleeve segments and said wood supporting tubes for releasably maintaining said tubes in said extended position.

16. The wood splitter of claim 15 and further comprising a collar extending about and slidably mounted on said wood supporting tubes, said ram means being fixedly connected to said collar.

17. A hydraulic wood splitter adapted to be connected to a tractor, or the like, comprising:

front mounting means for effecting a fixed connection to said tractor;

an elongated wood supporting frame connected to said front mounting means and extending rearwardly therefrom, said frame having oppositely disposed ends;

means on said frame for splitting wood including hydraulic ram means mounted on said wood supporting frame and movable thereover;

height adjustment means pivotally connecting said wood supporting frame and ram to said front mounting means;

locking means for releasably locking said wood supporting frame at any desired elevation; and elevator means associated with said height adjustment means and selectively movable into engagement with said ram means whereby movement of said ram means effects raising or lowering of said wood supporting frame.

18. The wood splitter of claim 17 in which said height adjustment means comprises linkage means effective for maintaining the horizontal orientation of said wood supporting frame at all elevations thereof.

19. The wood splitter of claim 18 in which said front mounting means comprises a first mounting plate, a second mounting plate carrying said wood supporting frame and ram, and said linkage means pivotally interconnects said first and second mounting plates in substantially parallel relationship.

20. The wood splitter of claim 19 in which said linkage means comprises a top link and a bottom link pivotally connected to said mounting plates and arranged to provide a four-bar linkage.

21. The wood splitter of claim 17 in which said means for splitting wood further includes a splitting wedge fixedly mounted on said wood supporting frame adjacent the rear end thereof and said ram is movable toward said splitting wedge.

22. The wood splitter of claim 17 in which said wood supporting frame comprises a pair of parallel, spaced cylindrical tubes.

23. The wood splitter of claim 22 and comprising further a pair of cylindrical sleeves slidably mounted on said tubes, said ram being fixedly connected to said sleeves whereby said tubes provide a trackway for said ram.

24. The wood splitter of claim 17 in which said elevator means comprises an elevator link having a pressure bar and an elongated arm projecting from the end of said bar, said arm being pivotally connected to said height adjustment means whereby said pressure bar may be pivoted between an inoperative position and an operative position wherein said bar is upon said wood supporting frame in the path of said ram.

25. The wood splitter of claim 20 and comprising further a lift plate depending from said top link adjacent the front end thereof, said elevator means comprising an elevator link having a pressure bar and an elongated arm projecting from said bar, said arm being pivotally connectable to said lift plate whereby said bar may be pivoted between an inoperative position and an operative position wherein said bar is upon said wood supporting frame in the path of said ram, so that movement of said ram causes actuation of said four-bar linkage.

26. The wood splitter of claim 21 in which said splitting wedge comprises a cutting edge facing toward said ram, said cutting edge being mounted at an acute angle with relation to the plane of said supporting frame.

27. The wood splitter of claim 26 in which said splitting wedge comprises further a tubular rear edge of greater diameter than the thickness of said wedge blade.

28. The wood splitter of claim 27 and comprising further a standard and base cooperating telescopically with said tubular rear edge, and adjustment means for releasably locking the tubular rear edge and standard in a plurality of positions for stabilizing the upraised wood supporting frame.

29. The wood splitter of claim 2 in which said locking means comprises a slotted link pivotally connected to said second mounting plate and bottom link, a threaded bolt on said top link and positioned through said slotted link, and a wing nut threadedly engaged on said threaded bolt.

30. A hydraulic wood splitter adapted to be connected to a tractor, or the like, comprising:

a first mounting plate for fixed attachment to said tractor;

a top link and a bottom link pivotally connected at one end thereof to each lateral side of said first mounting plate;

a second mounting plate substantially parallel to said first mounting plate and pivotally connected at each lateral side thereof to the opposite ends of said top links and bottom links;

said links and mounting plates providing a pair of four-bar linkages;

an elongated wood supporting frame fixedly mounted on said second mounting plate and projecting rearwardly therefrom;

a splitting wedge fixedly mounted on said wood supporting frame adjacent the rear end thereof;

hydraulic ram means mounted on said second mounting plate and movable over said wood supporting frame and toward said splitting wedge;

a lift plate depending from each of said top links adjacent said one end thereof;

an elevator link having a pressure bar and a pair of elongated arms projecting from the ends of said bar;

means pivotally connecting the free ends of said elongated arms to said lift plates whereby said pressure bar may be pivoted between an inoperative position and an operative position wherein the bar is upon said wood supporting frame and in engagement with said ram so that movement of the ram causes actuation of said four-bar linkages and elevation of said wood supporting frame; and locking means associated with said four-bar linkages for releasably locking said wood supporting frame in any desired location.

31. The wood splitter of claim 30 in which said locking means comprises a slotted link pivotally connected to said opposite ends of each of said bottom links, a threaded bolt on each of said top links positioned through said slotted link, and a wing nut threadedly engaged on each of said bolts for locking said slotted links in any desired position.

32. The wood splitter of claim 30 in which said wood supporting frame comprises a pair of parallel, spaced cylindrical tubes, said splitting wedge being secured between said tubes, and a pair of cylindrical sleeves slidably mounted on said tubes, said ram being fixedly connected to said sleeves.

* * * * *